US006241105B1

(12) United States Patent
Pomper

(10) Patent No.: US 6,241,105 B1
(45) Date of Patent: Jun. 5, 2001

(54) DISPLAY STAND

(76) Inventor: Yael Sonia Pomper, 715 Park Ave., Apartment 6B, New York, NY (US) 10021

( * ) Notice: Subject to any disclaimer, the term of this patent is extended or adjusted under 35 U.S.C. 154(b) by 0 days.

(21) Appl. No.: 09/499,903

(22) Filed: Feb. 8, 2000

Related U.S. Application Data

(60) Provisional application No. 60/158,665, filed on Oct. 8, 1999.

(51) Int. Cl.[7] ..... E05B 73/00; A47F 7/02

(52) U.S. Cl. ..... 211/85.2; 211/4; 211/163; 211/196; 211/205; 248/551; 206/6.1

(58) Field of Search ..... 211/85.2, 4, 6–7, 211/61, 205, 196, 163, 64, 124; 248/551, 156; 206/6.1, 279

(56) References Cited

U.S. PATENT DOCUMENTS

| | | | | |
|---|---|---|---|---|
| 1,445,803 | * | 2/1923 | Small et al. | 211/163 |
| 1,738,869 | * | 12/1929 | Cizek | 211/163 |
| 1,757,600 | * | 5/1930 | Sprowle | 211/163 |
| 3,424,317 | * | 1/1969 | Singer | 211/205 |
| 3,613,898 | * | 10/1971 | Brennan | 211/124 |
| 3,768,662 | * | 10/1973 | Ritzen | 211/4 |
| 3,788,489 | * | 1/1974 | Levinthal | 211/163 |
| 3,938,665 | * | 2/1976 | Rumble | 211/4 |
| 4,390,099 | * | 6/1983 | Trautlein et al. | 211/4 |
| 4,442,942 | * | 4/1984 | Cuminale et al. | 211/163 |
| 4,496,060 | * | 1/1985 | Anderson et al. | 211/124 |
| 5,052,563 | * | 10/1991 | Camp | 211/13.1 |
| 5,082,119 | * | 1/1992 | Bingley | 211/4 |
| 5,257,703 | * | 11/1993 | Ascik et al. | 211/13.1 |
| 5,458,249 | * | 10/1995 | Shang-Lu | 211/197 |
| 5,487,600 | * | 1/1996 | Griffin | 211/126 |
| 5,772,050 | * | 6/1998 | Shih | 211/163 |
| 5,819,766 | * | 10/1998 | Craigen | 211/86.01 X |
| 5,833,081 | * | 11/1998 | Smith | 211/86.01 |

* cited by examiner

*Primary Examiner*—Daniel P. Stodola
*Assistant Examiner*—Jennifer E. Novosad
(74) *Attorney, Agent, or Firm*—Seidel, Gonda, Lavorgna & Monaco, P.C.

(57) ABSTRACT

A jewelry display stand including a vertical post assembly mounted on a base. A plurality of arms, serving as hanger elements for jewelry or other merchandise, radiate from the post. The arms co-operate with anti-removal elements on the post that prevent merchandise from being removed from the spokes. In one embodiment a ring engaging the tips of the arms provides the anti-removal elements. In another embodiment the anti-removal elements are a set of spokes above the arms. Either the arms or the spokes are movable up and down and are spring-biased upwards, to a position in which the arms are separated from the anti-removal elements and merchandise can be removed from or placed on the arms. A cap on the post engages the movable elements, holding them down, and keeping the arms engaged with the ring or spokes. A slot in the cap allows one arm or spoke to rise to the non-engaging position, and the cap is rotatable about a vertical axis so that the slot can be aligned with any selected arm or spoke. Thus, merchandise can be removed from only the selected arm, reducing the risk of pilferage.

13 Claims, 5 Drawing Sheets

DISPLAY STAND

This application is based on provisional application Ser. No. 60/158,665, filed on Oct. 8, 1999.

BACKGROUND OF THE INVENTION

The present invention relates to an improved merchandise display stand for supporting jewelry chains or necklaces.

In my earlier patent, U.S. Pat. No. 5,848,710, there is disclosed a merchandise display stand comprising a vertical post mounted on a base. A plurality of radially spaced spokes adapted to hold the merchandise to be displayed is mounted on the upper end of the post. A separate closure ring adapted to co-operate with the spokes is also attached to the upper end of the post. The spokes and/or the ring are manually movable in a vertical direction relative to the post to allow merchandise to be placed on the spoke or removed therefrom.

As a result a sales clerk must manually raise each spoke and hold each spoke in the raised position in order to open the spoke from the ring so as to hang or to remove the merchandise from display. During the sales day the sales clerk needs to constantly re-raise and hold each spoke to accommodate the customers. To do so the clerk is required to use both hands in order to handle the merchandise, i.e. she must hold the spoke raised with one hand while simultaneously handling the merchandise with her free hand. The display device of my prior patent, while successfully preventing theft and providing an aesthetically pleasing sales display is somewhat difficult to use. In addition the display device requires constant attention during manipulation.

Accordingly, an object of the present invention is to provide an improved display stand for holding and exhibiting articles of jewelry.

Another object is to provide a display stand which maintains features for preventing or minimizing theft, shop lifting or pilferage therefrom while simplifying the use and manual operation of the device.

A further object is to provide a display stand which is simple to construct, aesthetically appealing, inexpensive to manufacture.

These objects together with other objects and advantages are set forth in the following disclosure of the present invention.

SUMMARY OF THE INVENTION

In general, the display stand of the present invention comprises a vertical post assembly mounted on a base. A plurality of spokes and a retaining ring are mounted at the upper end of the post. The spokes are movably mounted to be normally biased in an upward direction. Rotatably attached to the upper end of the post is a center cap adapted to retain said spokes depressed with the post. The cap has an axial slot permitting a selected one of said spokes to automatically raise, when properly rotated.

Full details of the present invention are set forth in the following description of the invention.

BRIEF DESCRIPTION OF THE DRAWINGS

The invention will be best understood by reference to the following drawings, wherein.

DETAILED DESCRIPTION OF THE INVENTION

Figure 1:
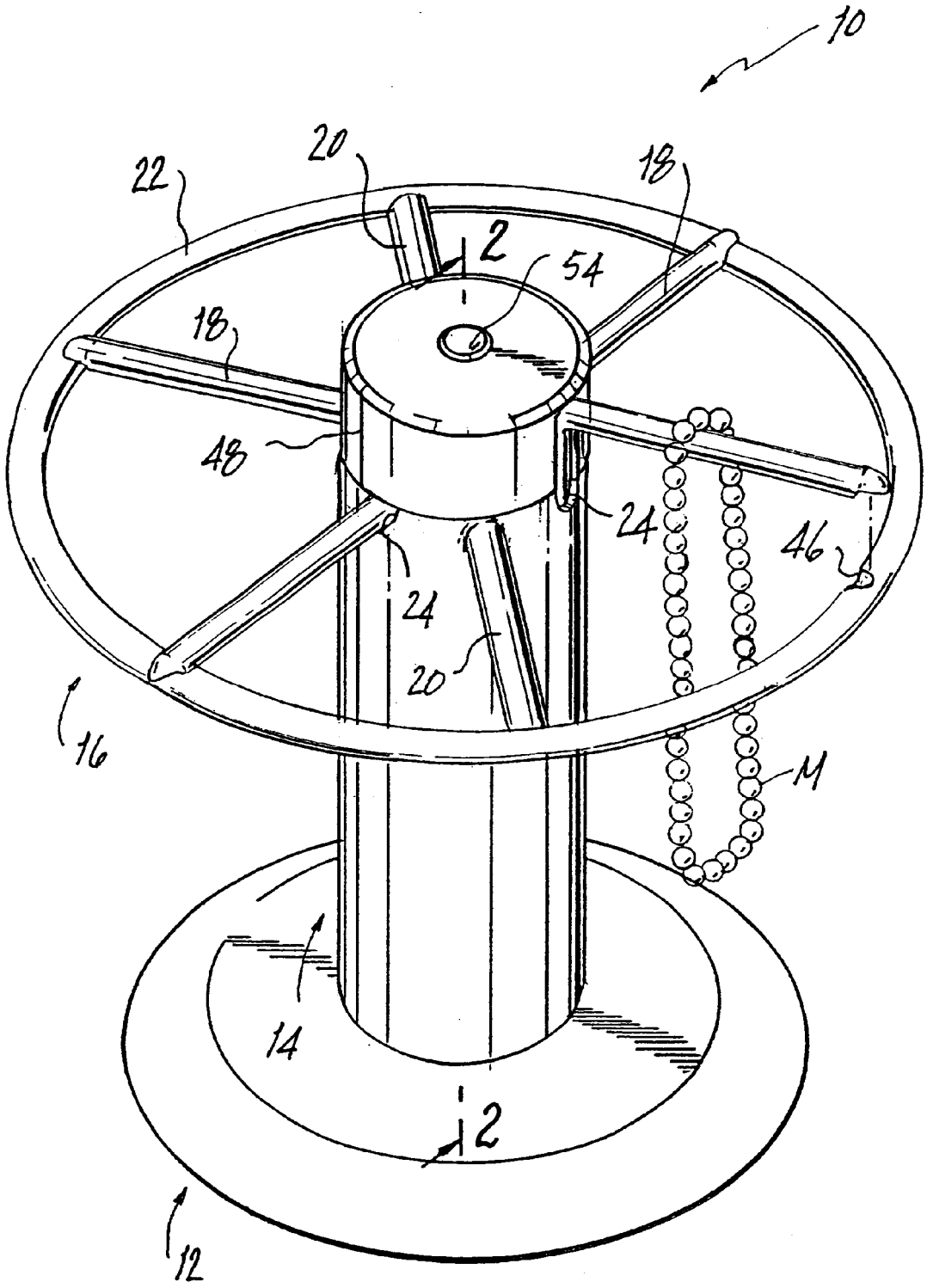
FIG. 1 is a perspective view, of a display stand showing the present invention.
Figure 2:
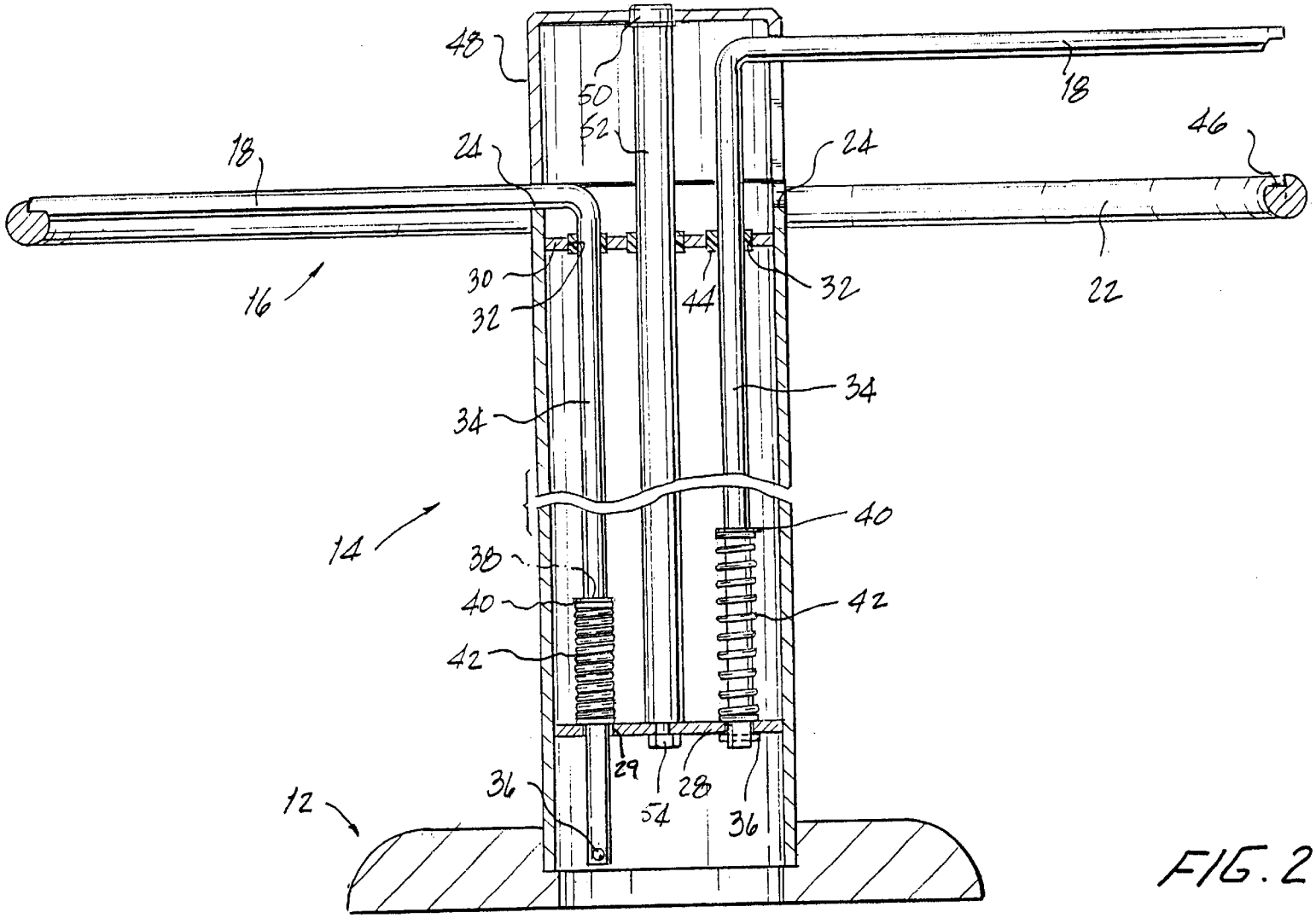
FIG. 2 is an enlarged cross sectional view taken along A—A of FIG. 1.
Figure 3:
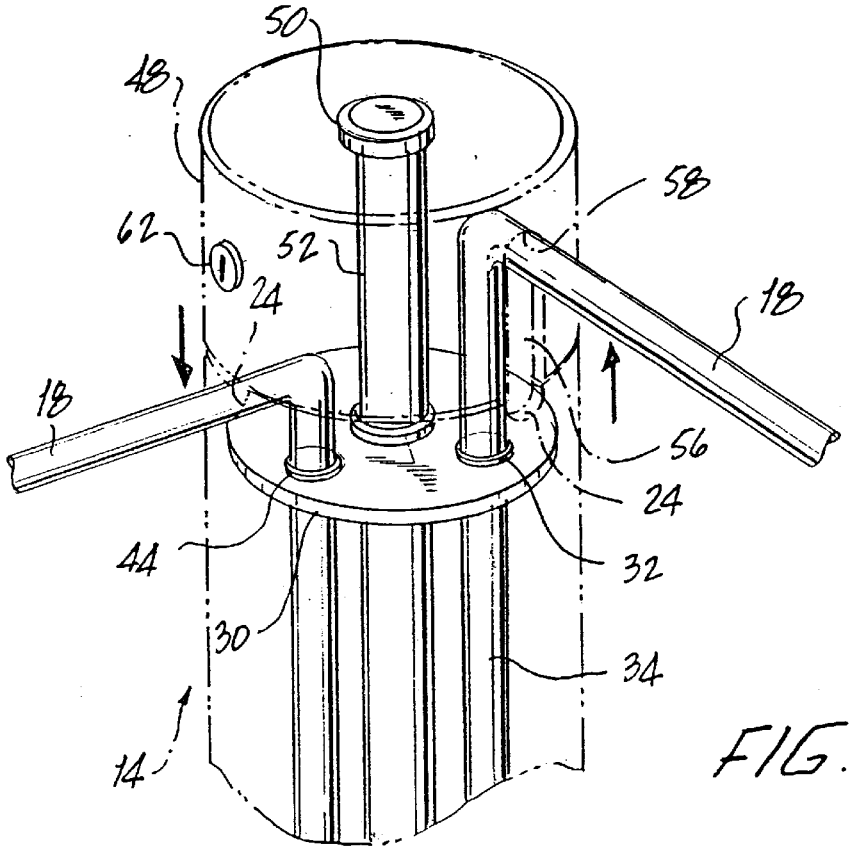
FIG. 3 is an enlarged perspective view, partially sectioned, of a display stand showing the internal construction of the post assembly.
Figure 4:
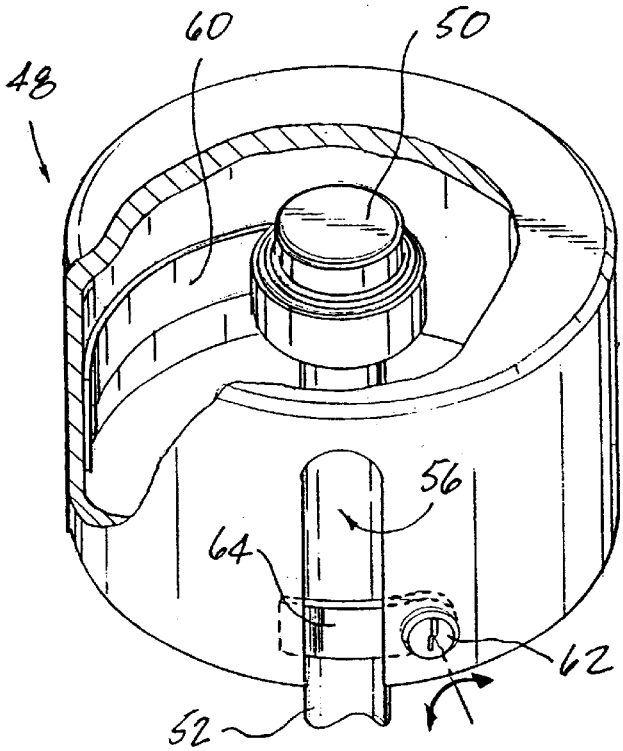
FIG. 4 is an enlarged perspective view, partially sectioned, of the display stand cap and locking mechanism.

As seen, the display stand generally designated by reference numeral 10, comprises a base 12, a vertically oriented hollow cylindrical post 14 mounted thereon and a horizontally oriented hanger assembly 16 mounted at the upper end of the post 14. The hanger assembly 16 comprises a plurality hanger elements in the form of of spokes 18 arrayed radially from the post 14 anti removal elements in the form of and a closure ring 22 fixed by a pair of arms 20 to the post 14. The closure ring 22 acts to normally close the end of the spoke 18 to retain merchandise M thereon, thereby acting as an anti-removal device.

The lower end of the post 14 is removably secured to a central opening preferably should have mating threads to allow the post 14 to be secured to the base 12. Attached to the upper end of the center post 14 is a pair of diametrically extending arms 20 to the radial outer ends of which is attached a closure ring 22. The top edge or rim of the center post 14 is provided with a plurality of notches 24 into which the spokes 18 sit.

Located within the upper end of the post 14 is a shaft 52 on which is hung a pair of plates 28 and 30, which are provided with guide holes 29 and 32 respectively. Plate 28 is fixed to the mid-point of the interior of the center post 14 while the other plate 30 is fixed to the upper end of center post 14 just below the notches 24. The plates 28 and 30 are aligned such that all of the holes 29 and 32 axially correspond to one another as welt as being radially aligned with each notch 24 so as to guide the spokes 18.

The spokes 18 are the longitudinal extensions of an elongated rod 34 bent mid-way between the ends, in an I-shaped fashion. Each rod 34 passes loosely through a respective guide hole 32 and a respective guide hole 29 so as to be vertically movable. A cotter pin 36 prevents the rod 34 from rising out of guide hole 29. While a cotter pin is used to prevent the rod from rising out of the guide hole 29 any other retention means (i.e. a cap) may be used. The rod 34 is also provided with a circumferential groove 38 spaced a distance upward from cotter pin 36, in which a C-clamp 40 is seated. An open helical compression spring 42 is wound about each rod 34 between the plate 28 and the C-clamp 40. Alternatively, C-clamp 40 can be replaced with a through hole and cotter pin configuration, a collar grip and bolt, a fitters clamp or any other means which would cause the compression spring 40 to become compressed as the rod 34 is lowered. In normal use, the compression spring 42 keeps the spokes 18 biased upwardly.

Having the upper end of each rod 34 pass through guide holes 32 ensures that each rod 34 is raised and lowered solely in a vertical axis. Each guide hole 32 is provided with a bushing 44 for smooth axial movement of each rod 34.

The closure ring 22 is provided with a plurality of indents or recesses 46 on its upper surface into which the ends of the spokes 18 are received so that when each rod 34 is in the lowered second position, the end of the spoke 18 sits in a corresponding recess 46 preventing unauthorized removal of merchandise. When the rod 34 is in the raised first position, the end of the spoke 18 is spaced a vertical distance away from the recess 46 so that merchandise can be added or removed from the display 10 as needed.

Movement of the integral spoke 18 and rod 34 is controlled by a cap 48 which is rotatably journaled, by bearing 50, to the upper end of a center shaft 52. The outer race of hearing 50 is fixedly attached to the center of the cap 48 while the inner race of bearing 50 is fixedly attached to the upper end of center shaft 52. The center shaft 52 passes through the center of the plates 28 and 30 respectively and is secured in place by a threaded nut 54. In this manner, the cap 48 is free to rotate about the center shaft 52.

The cap 48 is cup shaped, having a horizontal wall and depending skirt. The cap 48 is provided with a single axial slot 56 in its skirt which does not extend to the horizontal wall. The bottom of the slot 56 creates a stop 58. The lower peripheral edge, or lip of the cap 48, except for the opening of the slot 56, provides a cam surface against which the spokes 18 ride when the cap 48 is rotated.

In use, all of the spokes 18 are initially in a second depressed position and the cap 48 rotated so that the slot 56 is out of register with any of the spokes 18. The lower edge of cap 48 acts as a barrier which prevents the spokes 18 from rising until the slot 56 is moved into alignment with a selected spoke 18. When the slot 56 of the rotating cap 48 is moved in line with the selected spoke 18, the selected spoke 18 is automatically raised to a first position under bias of the compression spring 42. The display 10 is thus opened and remains in an opened position, locked in place by the continual force of the compression spring 42. To close the display 10, the sales clerk pushes down on the spoke 18, thus re-compressing the spring 42, and thereafter rotates the cap 48 so as to move the edge of the lip above the spoke 18.

In order to provide for the automatic return of the cap 48 to a closed position, wherein all of the spokes are depressed, a coil or spiral spring 60 is attached at one end to the cap 48 and at its other end to the center shaft 52. In this manner the cap 48 is rotatively biased with respect to the post 14 into its initial normal position.

The cap 48 may also be provided with locking means comprising a tongue 64 and a key operated pivot 62 which prevents any spoke 18 from being inadvertently raised, no matter what rotation of the cap 48 occurs.

The display stand of the present invention may be built of metal tubing, i.e. chrome or brass which are most suitable for their appearance as well. Other metals can, of course, be used.

While the base 12 is depicted as being circular in shape it may, in fact, take any shape or form. Also, while the post 14 is cylindrical, any ornamental contour can be utilized or any finish applied to create the aesthetic effect desired by the retailer.

Figure 5:
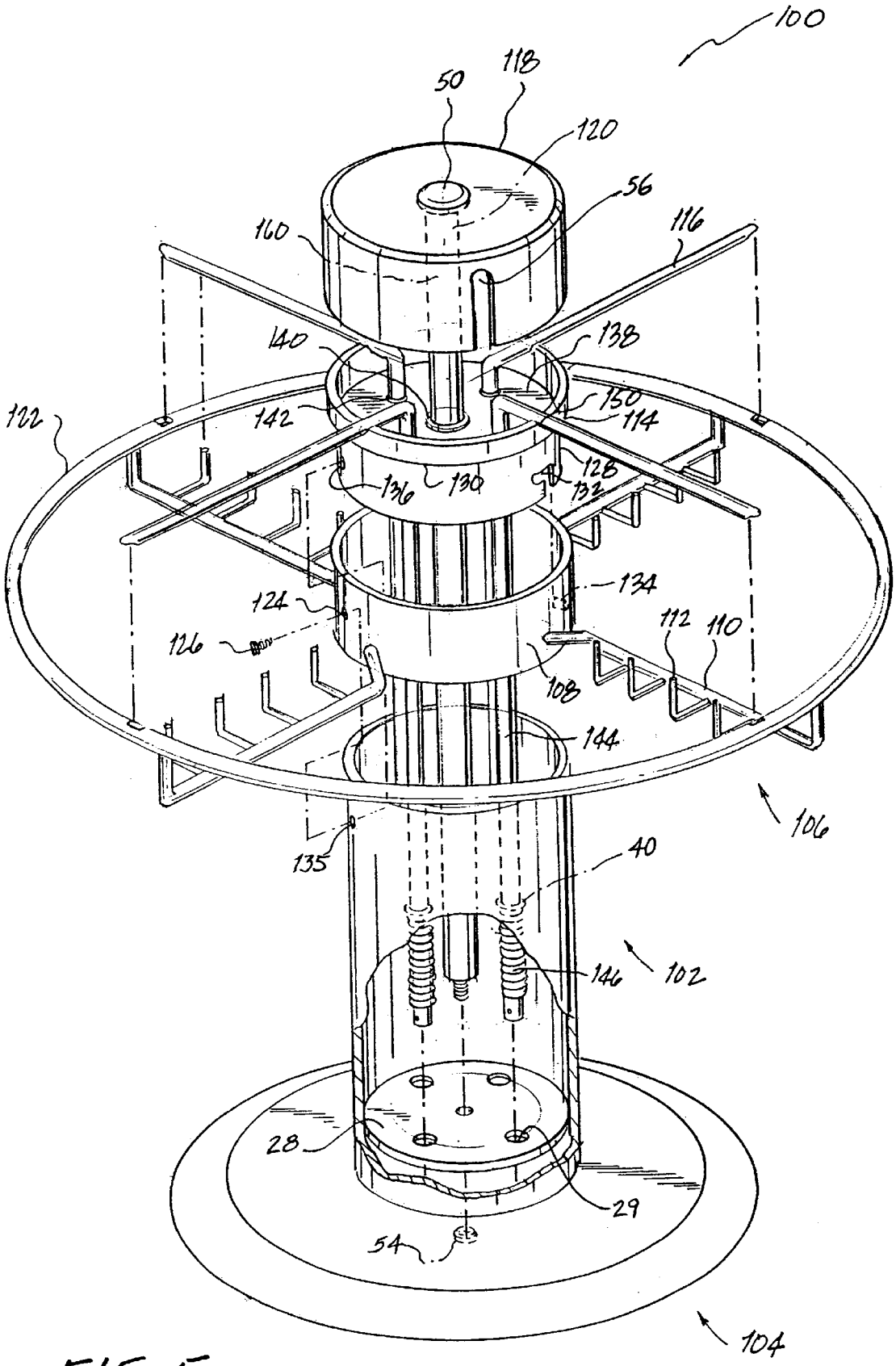
FIG. 5 is a perspective view, of a second embodiment of a display stand incorporating the inventive features of the present invention.

In FIGS. 5 to 8 a modified display stand 100 employing the present invention is shown. The display stand is generally formed of a cylindrical post 102, mounted on a conventional base 104, on which is located a display wheel 106, consisting of a cylindrical hub 108 having an inner diameter slightly larger than the outer diameter of the post 102 so that it fits over and seats on the top of the post 102. A plurality of hanger elements in the form of radially extending arms 110 (4 being shown) are fixedly attached to the hub 108. Each arm 110 has a plurality of hangers 112 on which product is held. Supported on the hub 108 is a manifold receptacle 114 housing the guide plate in which a plurality of anti-removal elements in the form of retention spokes 116 are located. The arms 110 are angularly offset from the radius as depicted in FIG. 5 in order to accommodate the radially extending spokes 116. A cap 118 is rotatably mounted over the manifold receptacle 114 and the entire assembly held together by a central shaft 120 all operating in the manner previously described.

The retention spokes 116 are normally closed over the hangers 112 of the display wheel 106 to prevent removal of the products being displayed, thereby acting as an anti-removal element. The selection cap 118 is rotatable to specifically select a single retention spoke 116 allowing it to be raised for the removal only of the goods held by the corresponding arm 110. The arms 110 are fixed at their outer ends to a ring 122 which joins the arms 110, in common and acts to stabilize the arms 110.

The manifold receptable 114 comprises a cylindrical stub body 128 having a smaller exterior diameter, at its lower end, than the interior diameter of the post 102, and a slightly larger diameter at its upper end providing a shoulder 130 against which the hub 108 and post 102 will seat when the narrower end of the manifold receptacle 114 is inserted in the post 102. The wall of the manifold receptacle 114 is provided with an L-shaped slot 132 into which a pin 134 extending inwardly from the surface of the hub 108 fits, allowing the manifold receptacle 114 to be locked into place, bayonet fashion.

Each of the post 102, the hub 108 and the manifold receptacle 114 are formed with a threaded hole 124, 135 and 136 respectively. The post 102, hub 108 and manifold receptacle 114 are then fastened together in fixed position by a screw 126.

Secured within the body of the manifold receptacle 114 is a transverse plate 138 having a central opening 140 and a plurality of bushings 142 arrayed about the central opening. The number of bushings 142 will generally conform to the number of retention spokes 116. Each bushing 142 is adapted to receive the elongated stem 144 of a respective spoke 116. The spokes 116 are constructed similar to those shown and described earlier and are biased by compression springs 146 in the same manner. To allow for full seating of the spokes 116, the upper edge of the manifold receptacle 114 is provided with semi-circular indents or notches 150 corresponding to each spoke 116.

From this point in the disclosure on, the construction of the post 102, the spokes 116, the cap 118, the biasing means and the like are identical to the structure previously shown and described and further description is referred thereto.

The entire device is assembled by first installing each of the spokes 116 by their stems 144 through the bushings 142 and the compression springs 146 positioned into place. Thereafter the display wheel 106 is placed onto the post 102 and by then installing the manifold receptacle 114 onto the hub 108 and post 102. The selection cap 118 is thereafter inserted over the manifold receptacle 114 so that the central shaft 120 passes through the center of the manifold receptacle 114 until an enlarged upper end 160 of the central shaft 120 abuts against the plate 138 within the manifold receptacle 114. The spokes 116 are thus retained within their respective notches 150.

Figure 6:
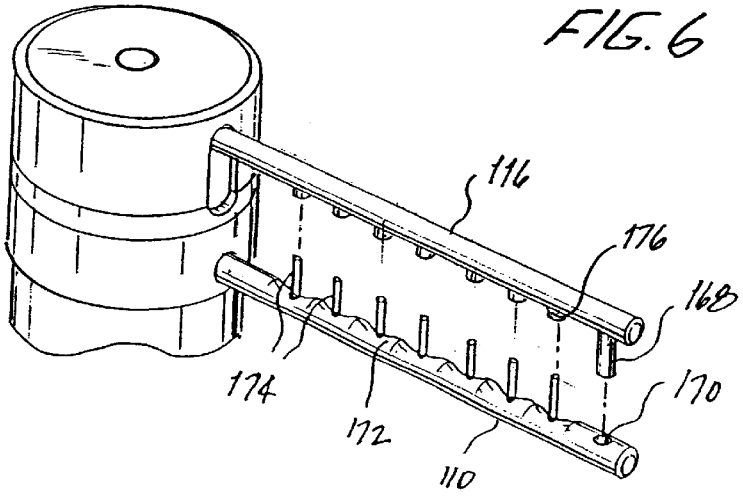
FIG. 6 is an enlarged perspective view of an additional embodiment of the display apparatus according to the present invention.

In another embodiment, shown in FIG. 6, the arms 110 terminate in a free end having a cavity or recess 170 rather than in a ring 122. On the other hand the spokes 116 terminate in a downturned end 170 which is inserted into the cavity 168, when spoke 116 is lowered to the closed position, preventing the removal of the product therefrom.

In this embodiment, the arms 110 do not have offset hangers 112 although they are provided with a plurality of uniformly spaced indents 172 along their upper edge. Pins 174 may be inserted along the length of each arm 110 for the display of jewelry which has a clasp.

The display shown in FIG. 6 is particularly useful with jewelry having a clasp which includes a retaining ring. The pins 174 permit the clasp ring to be slipped over the end of pin 174 and prevented from being removed therefrom when arm 110 is lowered to the closed position to come into contact with the ends of each pin 174. A plurality of evenly spaced upside down cups 176 are located along the underside of each arm 110 and each aligned with a respective pin 174. Thus, when the arm 110 is lowered to the closed position, the cups 176 the pins 174 and thus further prevent possible removal of the jewelry therefrom. In this way, both clasped and unclasped jewelry can be displayed without fear of unauthorized removal.

Figure 7:
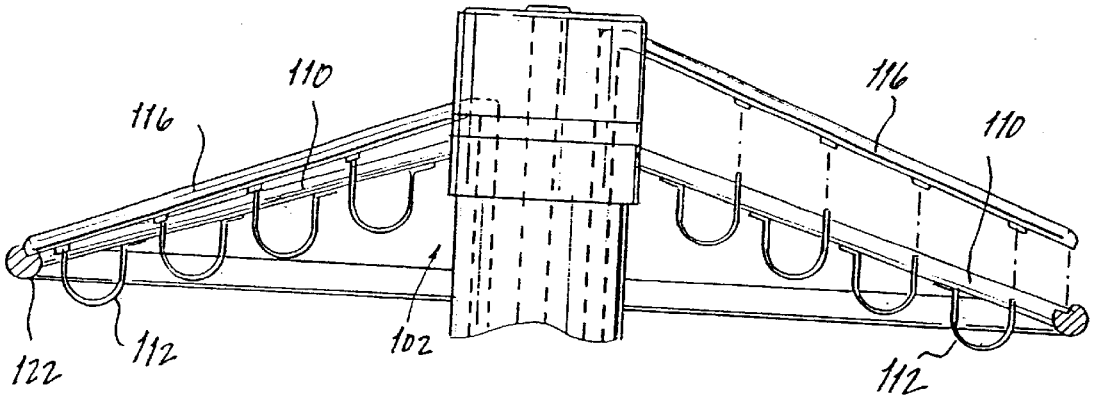
FIG. 7 is a side elevational view of an additional embodiment of the display apparatus according to the present invention.
Figure 8:
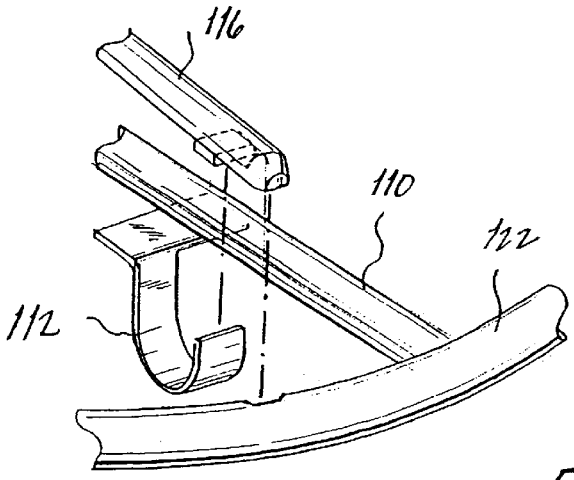
FIG. 8 is an enlarged perspective view of the closing features of the embodiment shown in FIG. 7.

In yet another embodiment, shown in FIGS. 7 and 8, the arms 110 as well as the spokes 116 are modified to tilt downward. In this configuration, merchandise, such as handbags, may be hung from the hangers 112 of arms 110 by their shoulder straps and allowed to freely hang down. Similarly cups 176 can be located along the underside of each arm 110 for engaging the free ends of the hangers 112 when in the closed position.

It should be pointed out that while the invention has been described in conjunction with womens' fashion items such as jewelry, bracelets, necklaces and handbags it must be realized that the invention can be effectively used for storing or holding a variety of other articles such as mens belts, chains, ties and the like. The invention effectively minimizes unauthorized removal of articles from the display device, and jewelry is highly susceptible to theft.

Various embodiments and modifications have been suggested herein and other changes and modifications will be obvious to those skilled in this art. Therefore, it is intended that the present disclosure be given wide scope and the invention limited only by the claims appendant hereto.

What is claimed is:

1. A merchandise display stand, comprising:

a center post supporting at its upper end an array of hanger elements and anti-removal elements cooperating with said hanger elements, each said hanger element being movable between a first position where said hanger element is in engagement with one of said cooperating anti-removal elements preventing merchandise from being removed from said hanger element and a second position where said hanger element is separated from said anti-removal element permitting merchandise to be placed on and removed from said hanger element, wherein said hanger elements are biased upward towards said second position and means are provided to retain said hanger elements in said first position against the upward bias, wherein the means for retaining said hanger elements comprises a cap mounted on the upper end of said center post having a lower edge adapted to engage and depress said hanger elements, wherein said cap is provided with a slot permitting entry of one of said hanger elements and permitting said hanger element to rise, and wherein said cap is rotatable about a vertical axis to permit said slot to be aligned with a selected one of said hanger elements.

2. The merchandise display stand according to claim 1, wherein said rotatable cap is spring biased to an orientation in which said slot is out of alignment with all of said hanger elements.

3. The merchandise display stand according to claim 2, wherein said cap is provided with locking means for preventing entry of said hanger elements into said slot.

4. The merchandise display stand according to claim 1, comprising a ring about said center post which comprises said cooperating anti-removal elements and wherein said hanger elements extend radially from said center post to a radius equal to the radius of said ring.

5. The merchandise display stand according to claim 1, wherein said center post is mounted at its lower end to a base.

6. A merchandise display stand comprising:

a center post supporting at its upper end an array of hanger elements and cooperating anti-removal elements, each said anti-removal element being movable between a first position where said anti-removal element is in engagement with one of said hanger elements preventing merchandise from being removed from said hanger element and a second position where said anti-removal element is separated from said hanger element permitting merchandise to be placed on and removed from said hanger element, wherein said anti-removal elements are biased upward towards said second position and means are provided to retain said anti-removal elements in said first position against the upward bias, wherein the means for retaining said anti-removal elements comprises a cap mounted on the upper end of said center post having a lower edge adapted to engage and depress said anti-removal elements, wherein said cap is provided with a slot permitting entry of one of said anti-removal elements and permitting said one anti-removal element to rise, and wherein said cap is rotatable about a vertical axis to permit said slot to be aligned with a selected one of said anti-removal elements.

7. The merchandise display stand according to claim 6, wherein said rotatable cap is spring biased to an orientation in which said slot is out of alignment with all of said anti-removal elements.

8. The merchandise display stand according to claim 7, wherein said cap is provided with locking means for preventing entry of said anti-removal elements into said slot.

9. The merchandise display stand according to claim 6, wherein said hanger elements further comprise a plurality of upwardly projecting pins.

10. The merchandise display stand according to claim 9, wherein said anti-removal elements further comprise a plurality of downwardly projecting caps for engaging said pins.

11. A merchandise display stand, comprising:

a center post supporting at its upper end an array of hanger elements and anti-removal elements, each said hanger element being movable between a first position where said hanger element is in engagement with one of said anti-removal elements preventing merchandise from being removed from said hanger element and a second position where said hanger element is separated from said anti-removal element permitting merchandise to be placed on and removed from said hanger element, wherein said hanger elements are biased upwards towards said second position; and a cap mounted on the upper end of said center post having a lower edge adapted to engage and depress said hanger elements into said first position against the upward bias, wherein said cap is provided with a slot permitting entry of one of said hanger elements and permitting said hanger element to rise, and wherein said cap is rotatable about a vertical axis to permit said slot to be aligned with a selected one of said hanger elements.

12. A merchandise display stand, comprising:

a center post supporting at its upper end an array of hanger elements and anti-removal elements, each said anti-removal element being movable between a first position where said anti-removal element is in engagement with one of said hanger elements preventing merchandise from being removed from said hanger element and a second position where said anti-removal element is separated from said hanger element permitting merchandise to be placed on and removed from said hanger element, wherein said anti-removal elements are biased upwards towards said second position; and a cap mounted on the upper end of said center post having a lower edge adapted to engage and depress said anti-removal elements into said first position against the upward bias, wherein said cap is provided with a slot permitting entry of one of said anti-removal elements and permitting said anti-removal element to rise, and wherein said cap is rotatable about a vertical axis to permit said slot to be aligned with a selected one of said anti-removal elements.

13. A merchandise display stand, comprising:

a center post supporting at its upper end an array of hanger elements and anti-removal elements, wherein in a first position each said hanger element and a said anti-removal element are in engagement and co-operate to prevent merchandise from being removed from said hanger element, said hanger elements or said anti-removal elements being individually movable to a second position, wherein when either the hanger element or the anti-removal element is in its second position it is separated from its cooperating anti-removal element or hanger element to permit merchandise to be placed on and removed from said hanger element; and a cap attached to the center post, the cap adapted to engage and retain said movable elements in said first position, wherein said cap is rotatable to select any one of said movable elements, and is arranged to permit only said selected one of said movable elements to move to said second position.

* * * * *